US005506570A

United States Patent [19]

Scott et al.

[11] Patent Number: 5,506,570

[45] Date of Patent: Apr. 9, 1996

[54] GASOLINE DISPENSER WARNING ANNOUNCES

[76] Inventors: Paul B. Scott, 17500 Lemarsh St., Northridge, Calif. 91325; Steve R. Vezerian, 151 W. Longden, Arcadia, Calif. 91007

[21] Appl. No.: 217,805

[22] Filed: Mar. 28, 1994

[51] Int. Cl.[6] ..... G08B 21/00

[52] U.S. Cl. ..... 340/603; 340/309.15; 137/553; 137/554; 222/39; 222/41

[58] Field of Search ..... 340/603, 608, 340/609, 686, 309.15; 137/553, 554; 222/20, 39, 41; 364/465; 455/66

[56] References Cited

U.S. PATENT DOCUMENTS 3,809,866 5/1974 Scoville ..... 235/151.34
4,250,550 2/1981 Fleischer ..... 364/465
4,630,754 12/1986 Komukai ..... 222/28
4,726,492 2/1988 Komukai ..... 222/14
5,018,645 5/1991 Zinsmeyer ..... 222/14
5,134,716 7/1992 Craig ..... 455/66

*Primary Examiner*—Brent A. Swarthout
*Assistant Examiner*—Julie B. Lieu
*Attorney, Agent, or Firm*—Harris, Wallen, MacDermott & Tinsley

[57] ABSTRACT

A warning announcer for a gasoline dispenser having a pump flow counter, a pump bar switch and/or a nozzle position sensor, a dispenser nozzle, and a nozzle receptacle, including a logic unit, a timer, a speaker, a voice alarm unit for providing a message to the speaker, a circuit for connecting signals from the pump flow counter and the pump bar switch or position sensor to the logic unit for controlling the timer to produce a message signal, and a circuit for connecting the timer to the voice alarm unit for initiating a message when the timer produces a messages signals.

3 Claims, 4 Drawing Sheets

FIG. 1A
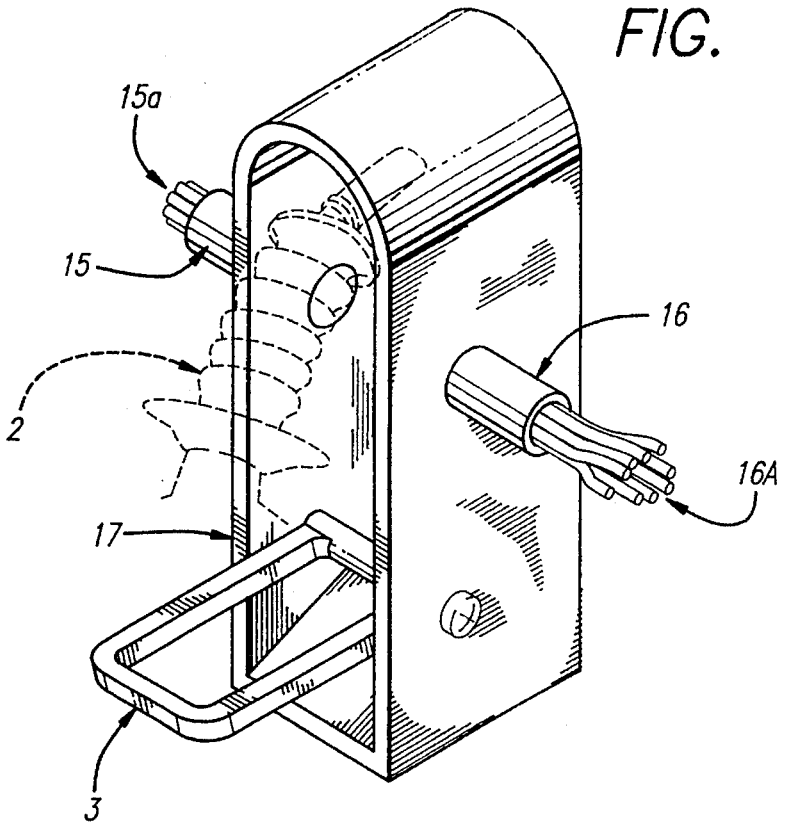
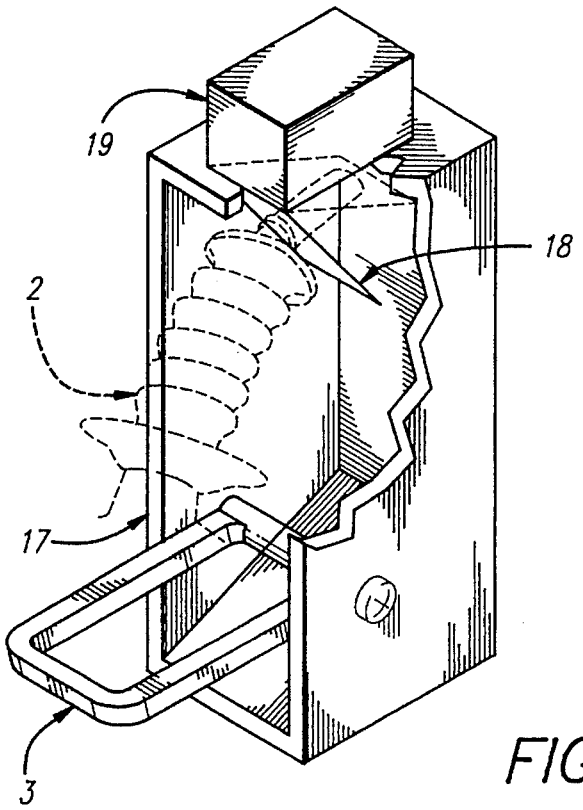
FIG. 1B

GASOLINE DISPENSER WARNING ANNOUNCES

BACKGROUND OF THE INVENTION

This invention relates to prevention of "drive-away" damage to gasoline station dispensers. Gasoline stations using self-service dispensers commonly suffer damage from customers neglecting to remove the nozzle and hose from the car before driving away.

The "drive-away" incident has become more common with the advent of self-service fueling, self-cutoff nozzles (which shut off when the tank fills, as now required by law), and convenience stores which distract the gasoline buyer from the fueling task.

Damage from a drive-away can vary from minor to extensive, with repair bills from $50.00 to over $10,000.00 and more if a fire is involved as a result of pulling over a dispenser. Personal injury can be incurred as an innocent customer is hit by the recoiling nozzle.

Environmental damage due to gasoline spills due to a drive-away incident is common. At the least, there will be evaporation of spilled gasoline. In worse cases, the gasoline spill often of several gallons will run off the concrete apron and contaminate the soil. Finally again there is the possibility of fire and smoke damage.

The modern fuel dispenser is an expensive and sophisticated device. It incorporates the pump with precision measurement devices, microprocessor controlled communications to the central control center inside the gas station office, and electronic displays to the customer. Within the dispenser one sees an array of plumbing in the lower part, and in the distinct "electrical" compartment (for fire protection) a jumble of circuit boards and wiring harnesses. This modern fuel dispenser was priced in 1993 typically just under $20,000.00.

These drive-away incidents may be thought laughable and unusual, but they are a monthly occurrence at any large service station. A typical repair bill is $500.00 to $1,000.00, which must be collected from the car owner or be absorbed by the service station owner.

One attempted solution has been to provide "breakaway" hose connectors that are designed to fail at few hundred pounds of tension, such as to avoid pulling over the dispenser. The breakaway devices themselves are expensive, and are only a means to limit the damage.

It is an object of this invention to provide a device to prevent such damage by speaking a warning message "REMOVE THE NOZZLE FROM THE TANK!" to the customer if it appears he has stopped pumping and has not replaced the pump nozzle at the dispenser.

It is another object of this invention to provide other prerecorded messages to the customer, which could be used at will by the station owner either to provide an educational safety warning or to advertise the stations "special of the week".

Other objects, advantages, features and results of the invention will appear in the course of the following description.

SUMMARY OF THE INVENTION

In its preferred embodiment, the gasoline dispenser warning announcer of this invention uses the dispenser flow sensing device, a nozzle return sensor in combination with logic circuitry which enables the announcer device only if the pump is switched on but fuel is not flowing, an electronic timer which provides a delay such that the warning will be played after an appropriate delay (approximately five to ten seconds) following the cessation of fuel flow, digital storage of the voice message and circuitry to reconstruct and "speak" the digitized voice message. Ancillary circuitry may be used to provide capability to speak a message while fuel is flowing. The flow sensing device is generally that which is used for the measurement of fuel flow, which is already incorporated in the dispenser. The nozzle return sensor may be-the pump "on" switch which is actuated by raising the pump bar which in most dispenser designs can be raised to "on" only after-removing the nozzle from the dispenser. Alternatively, the nozzle return sensor may be a position sensor which senses that the fuel nozzle is not in its stowed position in the receptacle.

BRIEF DESCRIPTION OF THE DRAWINGS

FIG. 1A is an enlarged partial view similar to that of FIG. 1 showing an alternative embodiment for the switch bar of FIG. 1;

FIG. 1B is a view similar to that of FIG. 1A showing another alternative embodiment for the switch bar of FIG. 1;

DESCRIPTION OF THE PREFERRED EMBODIMENTS

Figure 1:
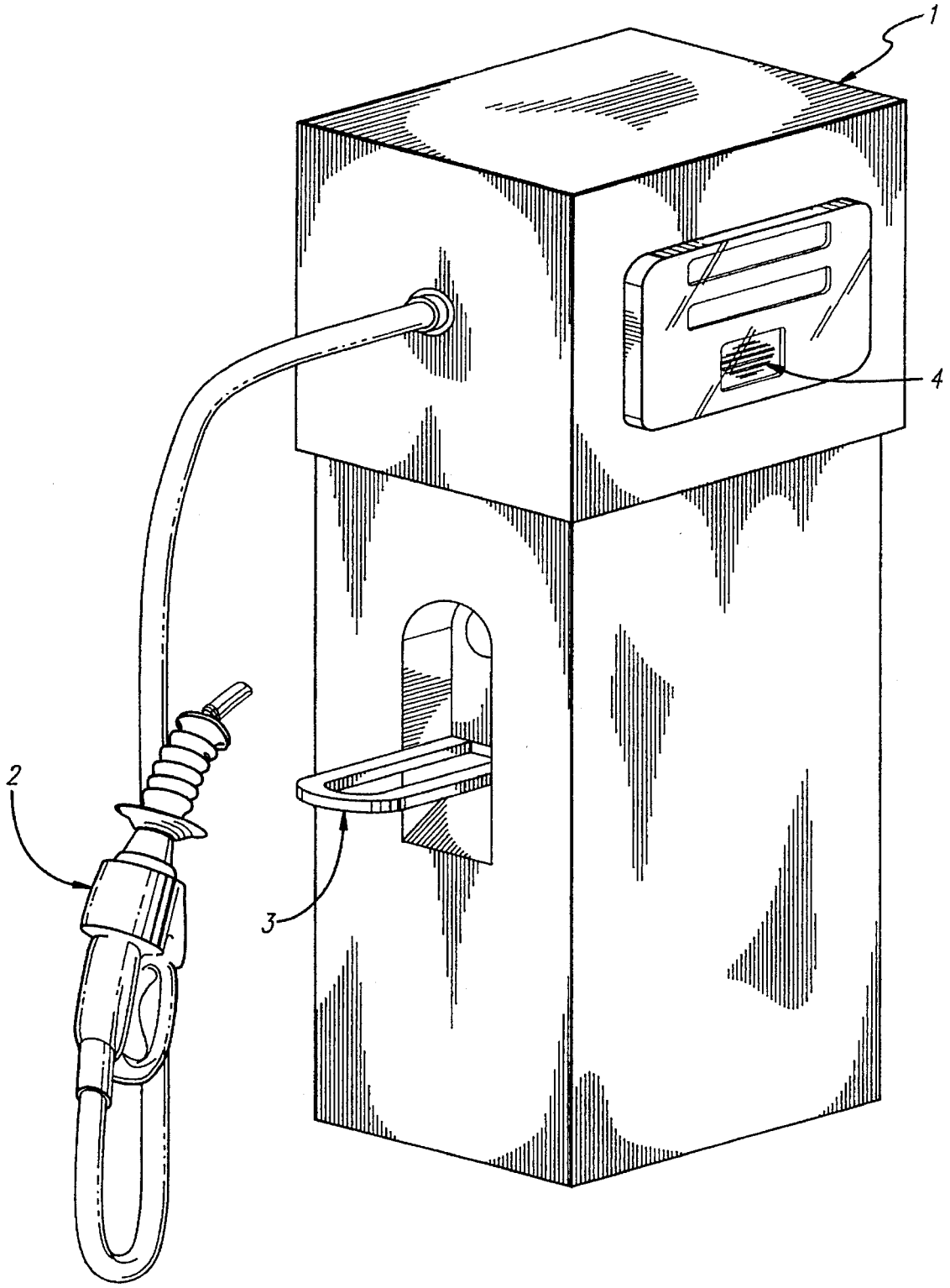
FIG. 1 shows a gasoline dispenser incorporating the presently preferred embodiment of the invention with the nozzle, switch bar, and announcer speaker of the subject invention.

FIG. 1 shows a dispenser 1 with a nozzle 2, a nozzle switch bar 3 and a loudspeaker 4. The user must raise the nozzle switch bar to start the gasoline pump in the dispenser. After pumping, the switch bar must be returned to the low position to replace the nozzle. The loudspeaker 4 is utilized to speak a voice warning to the self-pumping customer.

Figure 2:
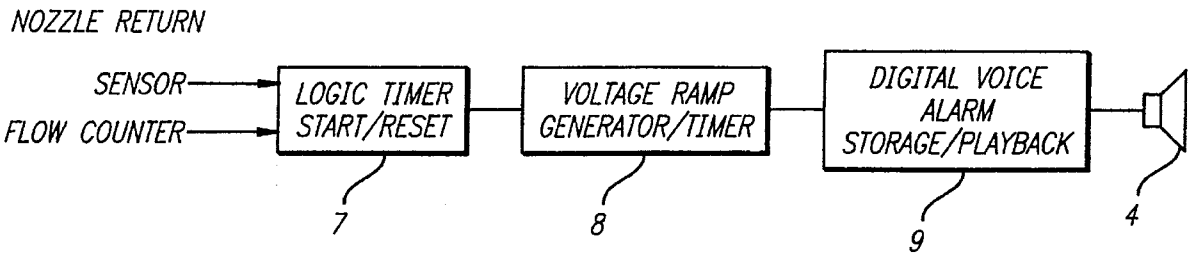
FIG. 2 is a block diagram illustrating the circuit components of the announcer of FIG. 1.

The diagram of FIG. 2 illustrates an electronic circuit including a logic unit 7, a timer 8 and an announcer voice alarm unit 9. The unit 9 will warn the customer if the switch bar is up and there is no fuel flow for a period in excess of a preset number of seconds. After the timed period the announcer unit, a digital circuit with stored voice messages, will give increasingly loud messages warning the customer.

Alternatively, the nozzle receptacle on the side of the dispenser may be equipped with a nozzle position sensor which will give a "ready" signal on removal of the nozzle from its resting position, which "ready" signal ends only when the nozzle is returned to its rest position. This "ready" signal may be used instead of the nozzle switch bar signal. It may be implemented with an optical beam interrupted by the nozzle in its rest position, which optical beam is sensed by a photocell on the opposite side of the nozzle receptacle on removal of the nozzle. A second implementation would be by microswitch activated by removing the nozzle. This use of a nozzle position sensor assures that the driver has completed the nozzle replacement.

Each dispenser is equipped with a flowmeter to measure the amount of fuel supplied. This flowmeter provides the fuel flow signal, in the form of a pulse train, which is active only when there is flow. The absence of this fuel flow signal, combined with a raised switch bar signal, will start the timer 8 so that the voice alarm will be activated after a few seconds.

The logic unit 7 Of the invention starts the timer 8 when the switch bar is raised, providing a logic input in the form of a voltage change. The fuel flow counter input to the logic continually resets the timer as the fuel is flowing.

Figure 3:
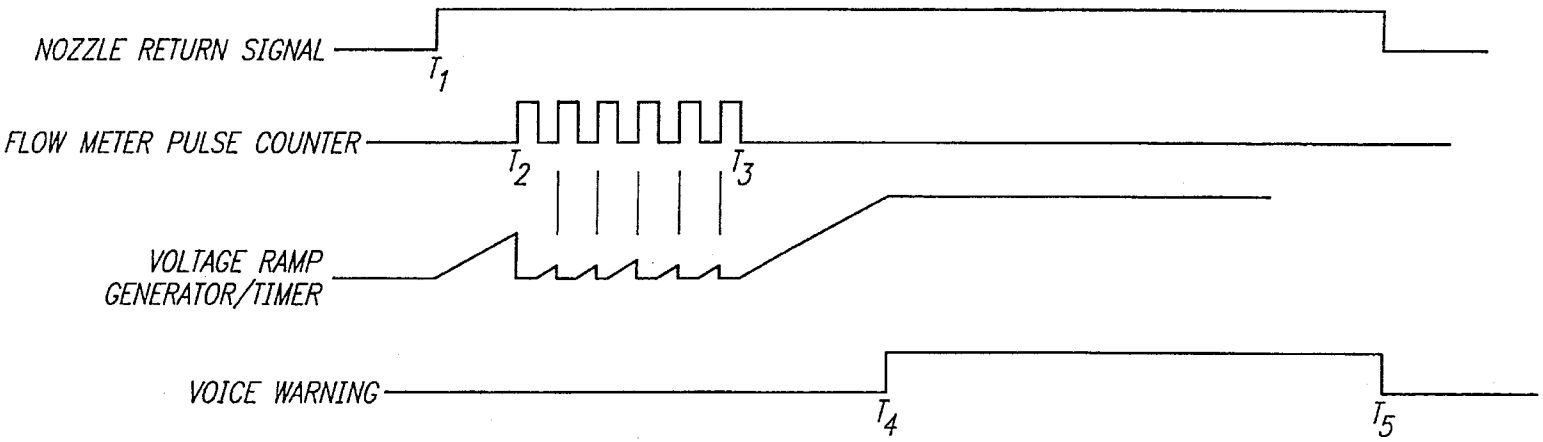
FIG. 3 is a timing diagram illustrating the operation of the announcer of the invention.

FIG. 3 illustrates the timing sequence of the announcer invention. T1 is the time the switch bar is raised, or in the case of the unit using the nozzle position sensor, T1 is the time of removing the nozzle from the dispenser. The flow counter pulses start shortly thereafter, at T2, which is expected to typically be within 3 to 10 seconds after T1. Each pulse from the flow counter resets the timer 8, so that the ramp increase of the timer voltage is repeatedly set to zero. At termination of the flow T3 the timer voltage is allowed to "time out" without resetting, unless the switch bar is returned low or the nozzle sensor registers the nozzle in its receptacle.

At T4, the end of the timer period determined by the timer voltage, the voice message starts. This could be as simple as "PLEASE REMOVE THE NOZZLE FROM YOUR CAR AND RETURN IT TO THE PUMP". Upon lowering the switch bar or returning the nozzle, the voice warning is terminated. If the switch bar is lowered or the nozzle is returned before the end of the timer period the voice message is never produced.

Figure 4:
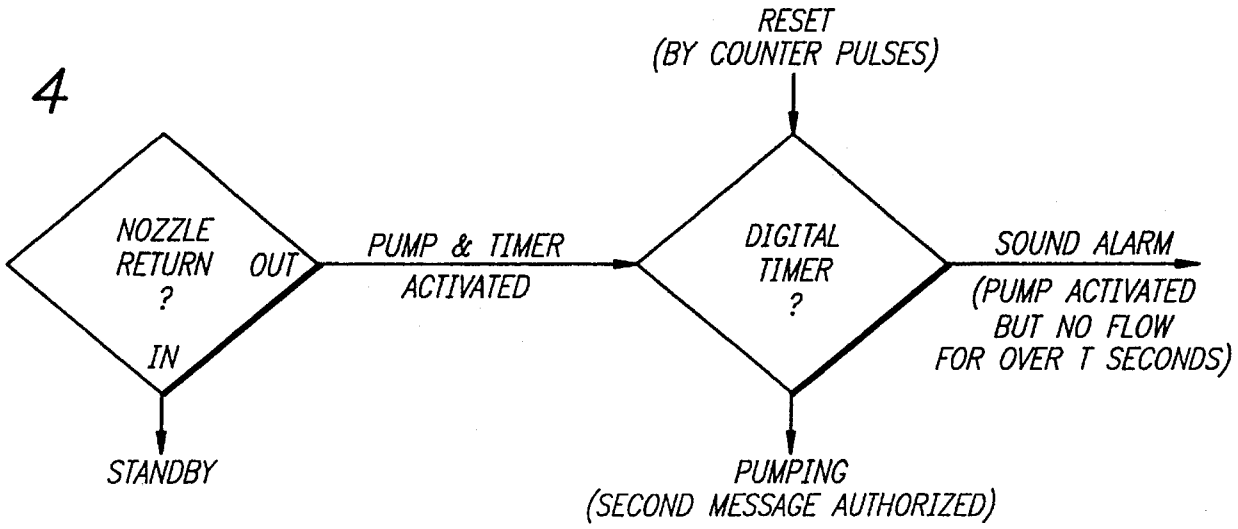
FIG. 4 is a block diagram illustrating an alternative embodiment utilizing a digital counter rather than a voltage ramp for the timer.
Figure 5:
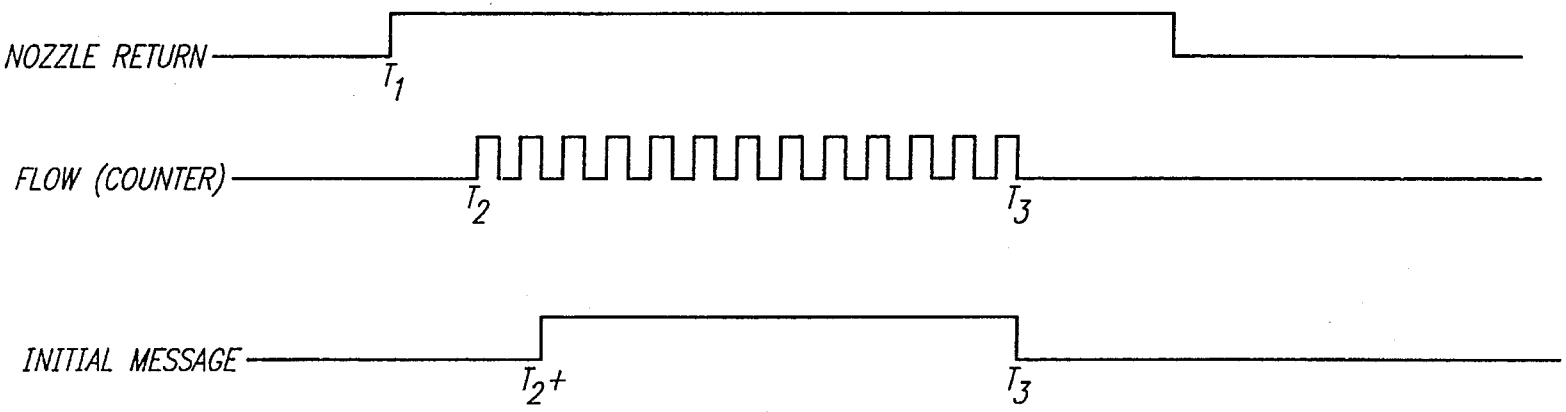
FIG. 5 is an additional timing diagram for incorporating a message while pumping.

In an alternative embodiment illustrated in FIG. 4, the timer 8 would use a digital counter, rather than a voltage ramp. With the switch bar up or the nozzle removed, both the pump and timer are activated. If gasoline is flowing, the counter pulses from the metering device continually reset the digital counter timer. Conversely, if the flow stops, the timer will sound the alarm after the preset period, unless the operator lowers the switch bar or returns the nozzle to the down position. A convenient form of this implementation would be to use a microprocessor which could be used for timing as well as for control of the voice message electronics.

Standard circuit components are used for the logic unit, the timer, and the voice unit.

An additional feature Of the invention is shown in FIG. 4, and includes the use of the digital voice announcer 9 for other messages. For instance, a message played during the gasoline flowing period, T2 to T3, could be used for welcoming the customer and for a safety message. Alternatively, the station manager may choose to advertise a special product to the customer while he is filling the tank. The station manager will be able to change this announcement by use of a plug-in microphone at will, whereas the pump-saver warning would not be changed. These announcements would terminate when the switch bar is returned to standby condition, or when an emergency "Pump Saver" announcement was needed.

An alternative embodiment for the switch bar nozzle return sensor is shown in FIG. 1A, with the pump switch bar 3 in the up or on position. A light source 15 and a light detector 16, typically a photocell, are mounted in opposite walls of the nozzle receptacle 17 of the gasoline dispenser. The source 15 is connected to a power source by leads 15A and the detector 16 is connected to the logic unit 7 by leads 16A.

When the nozzle 2 is positioned in the receptacle a nozzle returned or in signal is provided, while a nozzle out or not returned signal is provided when the nozzle is not in the receptacle, independently of the position of the switch bar.

Another alternative for the nozzle return sensor is shown in FIG. 1B. A microswitch activator plate 18 of a microswitch 19 is positioned in the receptacle 17 so that the microswitch is in one state, typically open, when the nozzle 2 is not in the receptacle, and in the opposite state when the nozzle is in place in the receptacle, as shown in phantom lines. The microswitch is connected to the logic unit 7, providing a nozzle out and in signal for the logic unit.

We claim:

1. A warning announcer for a gasoline dispenser for providing a warning message to a customer when the customer is no longer pumping gasoline and the nozzle is not positioned in the nozzle receptacle, the dispenser having a pump flow counter, a nozzle return sensor, a dispenser nozzle, and a nozzle receptacle, including in combination:

a logic unit;

a timer;

a speaker;

a voice alarm unit for providing a message to said speaker;

first circuit means for connecting signals from the pump flow counter and from the nozzle return sensor to said logic unit for controlling said timer to produce a message signal; and second circuit means for connecting said timer to said voice alarm unit for initiating a message when said timer produces a message signal indicating that the nozzle has not been returned to the nozzle receptacle;

said pump flow counter providing a pulse train as the pump flow counter signal, and said logic unit including means for turning on said timer on receipt of a pump flow counter pulse signal and for resetting said timer on continued receipt of pump flow counter pulses.

2. A warning announcer as defined in claim 1 wherein said timer includes a voltage ramp generator.

3. A warning announcer as defined in claim 1 wherein said timer includes a digital counter.

* * * * *

UNITED STATES PATENT AND TRADEMARK OFFICE

CERTIFICATE OF CORRECTION

PATENT NO. : 5,506,570

DATED : April 9, 1996

INVENTOR(S) : Paul B. Scott; Steve R. Vezerian

It is certified that error appears in the above-identified patent and that said Letters Patent is hereby corrected as shown below:

On the title page, item [76], and column 1, line 4
Title of invention should be:

(GASOLINE DISPENSER WARNING ANNOUNCER)

Signed and Sealed this

Thirtieth Day of July, 1996

Bruce Lehman

*Attest:*

BRUCE LEHMAN

*Attesting Officer*

*Commissioner of Patents and Trademarks*